US009874407B2

(12) United States Patent
Tomita et al.

(10) Patent No.: US 9,874,407 B2
(45) Date of Patent: Jan. 23, 2018

(54) HEAT EXCHANGER

(71) Applicants: Sho Tomita, Susono (JP); Rentaro Kuroki, Susono (JP)

(72) Inventors: Sho Tomita, Susono (JP); Rentaro Kuroki, Susono (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days.

(21) Appl. No.: 14/888,801

(22) PCT Filed: May 8, 2013

(86) PCT No.: PCT/JP2013/062952
§ 371 (c)(1),
(2) Date: Nov. 3, 2015

(87) PCT Pub. No.: WO2014/181404
PCT Pub. Date: Nov. 13, 2014

(65) Prior Publication Data

US 2016/0061535 A1 Mar. 3, 2016

(51) Int. Cl.
*F28F 1/00* (2006.01)
*F28F 9/22* (2006.01)
(Continued)

(52) U.S. Cl.
CPC ..... *F28F 1/00* (2013.01); *F02M 26/32* (2016.02); *F28D 7/16* (2013.01); *F28D 21/0003* (2013.01);
(Continued)

(58) Field of Classification Search
CPC .. F02B 29/04; F02B 29/0462; F02B 29/0475; F02B 29/0431; F02B 29/0437; F28D 2021/0082; F28D 21/0003; F28D 7/16
(Continued)

(56) References Cited

U.S. PATENT DOCUMENTS 5,178,210 A * 1/1993 Guillet ..... F23L 15/04 122/DIG. 1
6,220,522 B1 * 4/2001 Suzuki ..... F01P 3/20 237/12.1
7,774,937 B2 * 8/2010 Agee ..... F28D 7/1692 165/157
2008/0135221 A1 * 6/2008 Nakamura ..... F28D 9/0025 165/165
(Continued)

FOREIGN PATENT DOCUMENTS

DE 102008036778 A1 3/2009
DE 102011016122 A1 11/2011
(Continued)

*Primary Examiner* — Dominick L Plakkoottam
*Assistant Examiner* — Joel Attey
(74) *Attorney, Agent, or Firm* — Andrews Kurth Kenyon LLP

(57) ABSTRACT

A heat exchanger includes: heat exchanger bodies arranged in parallel, each allowing a fluid to be cooled to flow therethrough in one direction; a housing that forms a coolant passage that allows a coolant to flow therethrough around each of the heat exchanger bodies; a coolant inlet portion and a coolant outlet portion located in a position corresponding to first ends of the heat exchanger bodies in a flow direction of the fluid to be cooled; a separating portion that separates the coolant passages in a position corresponding to second ends of the head exchanger bodies in the flow direction of the fluid to be cooled so that a communicating portion that allows the coolant passages to communicate with each other is left; and a flow passage area increasing portion that increases a flow passage area of the communicating portion. This structure achieves good cooling performance in the heat exchanger.

9 Claims, 15 Drawing Sheets

(51) Int. Cl.

| | |
|---|---|
| ***F28F 13/00*** | (2006.01) |
| ***F28F 21/04*** | (2006.01) |
| ***F28D 7/16*** | (2006.01) |
| ***F02M 26/32*** | (2016.01) |
| ***F28F 7/02*** | (2006.01) |
| *F02B 29/04* | (2006.01) |
| *F28D 21/00* | (2006.01) |

(52) U.S. Cl.
CPC ..... *F28F 7/02* (2013.01); *F28F 9/22* (2013.01); *F28F 13/003* (2013.01); *F28F 21/04* (2013.01); *F02B 29/04* (2013.01); *F02B 29/0431* (2013.01); *F02B 29/0437* (2013.01); *F02B 29/0462* (2013.01); *F02B 29/0475* (2013.01); *F28D 2021/0082* (2013.01)

(58) Field of Classification Search
USPC ..... 165/157
See application file for complete search history.

(56) References Cited

U.S. PATENT DOCUMENTS

| | | | |
|---|---|---|---|
| 2009/0056682 | A1 | 3/2009 | Okawa et al. |
| 2011/0180242 | A1 | 7/2011 | Urata et al. |
| 2011/0247318 | A1 | 10/2011 | Kuroyanagi et al. |
| 2012/0247732 | A1 | 10/2012 | Suzuki et al. |

FOREIGN PATENT DOCUMENTS

| | | | |
|---|---|---|---|
| JP | 58-112870 | U | 8/1983 |
| JP | 11-241891 | A | 9/1999 |
| JP | 2001-027158 | A | 1/2001 |
| JP | 2003-065147 | A | 3/2003 |
| JP | 2007-093142 | A | 4/2007 |
| JP | 2007-132575 | A | 5/2007 |
| JP | 2007-211748 | A | 8/2007 |
| JP | 2011-153752 | A | 8/2011 |
| WO | 2011/071161 | A1 | 6/2011 |

* cited by examiner

CROSS SECTION TAKEN
ALONG LINE B2-B2

HEAT EXCHANGER

CROSS-REFERENCE TO RELATED APPLICATION

This is a national phase application based on the PCT International Patent Application No. PCT/JP2013/062952 filed May 8, 2013, the entire contents of which are incorporated herein by reference.

TECHNICAL FIELD

The present invention is related to a heat exchanger.

BACKGROUND ART

There has been conventionally known a variety of heat exchangers. For example, Patent Document 1 discloses a heat exchanger including a first fluid flow portion formed of a honeycomb structure having a plurality of cells to allow a heating medium as a first fluid to flow therein, and a second fluid flow portion located on an outer peripheral face of the first fluid flow portion. A coolant flows through the second fluid flow portion, taking heat from the heating medium flowing through the first fluid flow portion to cool the heating medium. Patent Document 1 also discloses layered honeycomb structures having gaps to allow the second fluid to flow therein.

PRIOR ART DOCUMENT

Patent Document

[Patent Document 1] International Publication No. WO2011/071161

SUMMARY OF THE INVENTION

Problems to be Solved by the Invention

However, when multiple honeycomb structures, i.e., multiple heat exchanger bodies, are provided as with the layered honeycomb structures disclosed in Patent Document 1, a coolant may stagnate or come to a boil depending on their arrangement. More specifically, the relation between the heat exchanger body and inlet and outlet ports of the coolant and the handling of the coolant may cause stagnation of or a boil of the coolant. The stagnation or a boil of the coolant decreases cooling efficiency. The technique disclosed in Patent Document 1 can be improved in these respects.

The present invention has an object to allow a heat exchanger to have good cooling performance.

Means for Solving the Problems

In order to overcome the above problem, a heat exchanger disclosed in the present description includes: heat exchanger bodies arranged in parallel, each allowing a fluid to be cooled to flow therethrough in one direction; a housing that forms a coolant passage that allows a coolant to flow therethrough around each of the heat exchanger bodies; a coolant inlet portion and a coolant outlet portion located in a position corresponding to first ends of the heat exchanger bodies in a flow direction of the fluid to be cooled; a separating portion that separates the coolant passages, each formed around the corresponding heat exchanger body, so that a communicating portion allowing the coolant passages to communicate with each other is left in a position corresponding to seconds ends of the head exchanger bodies in the flow direction of the fluid to be cooled; and a flow passage area increasing portion that increases a flow passage area of the communicating portion.

This structure reduces stagnation of the coolant, and allows the heat exchanger to have good cooling performance.

The coolant inlet portion and the coolant outlet portion may be located at a downstream side of the flow direction of the fluid to be cooled. This arrangement of the coolant inlet portion and the coolant outlet portion allows the coolant to be introduced from a downstream side of a flow of the fluid to be cooled, turn back its flow direction at an upstream side, flow toward the downstream side, and be discharged. The above described path of the coolant allows the flow of the coolant introduced from the coolant inlet portion and having a lower temperature to be countercurrent to the flow of the fluid to be cooled, enabling to increase cooling efficiency. Additionally, the temperature of the fluid to be cooled is low near the coolant outlet portion at which the temperature of the coolant is high, and thus a boil of the coolant in the heat exchanger is prevented.

A coolant guide portion that rectifies the coolant may be located in the coolant passage. The coolant guide portion may be helically located around each of the heat exchanger bodies. The efficient flow of the coolant enables to increase cooling efficiency.

A flow passage area of the coolant passage, a flow passage area of the communicating portion, a flow passage area of the coolant inlet portion, and a flow passage area of the coolant outlet portion may be equal to each other. Making the flow passage areas of the portions through which the coolant flows equal to each other enables to prevent a part at which pressure loss of the coolant enormously increases from being formed, and to improve cooling efficiency.

The separating portion may include a deflation portion. If air is entrapped into a part of the coolant passage, the part at which air accumulates becomes exposed from the coolant, and the exposed part may become high in temperature. The provision of the deflation portion prevents the exposed part from being formed.

Additionally, the coolant inlet portion may be offset from the heat exchanger body. This structure enables to generate a swirl flow of the coolant.

An inlet flow of the fluid to be cooled to a first heat exchanger body of the heat exchanger bodies may be greater than an inlet flow of the fluid to be cooled to a second heat exchanger body of the heat exchanger bodies, the first heat exchanger body being located closer to the coolant inlet portion than the second heat exchanger body. As the heat exchange body becomes closer to the coolant inlet portion, the temperature of the coolant decreases, and the cooling capacity increases. Thus, the cooling efficiency as a heat exchanger is improved by allowing more fluid to be cooled to flow into the heat exchanger body having higher cooling capacity.

Effects of the Invention

The heat exchanger disclosed in the present description achieves good cooling performance in a heat exchanger.

MODES FOR CARRYING OUT THE INVENTION

Figure 1A:
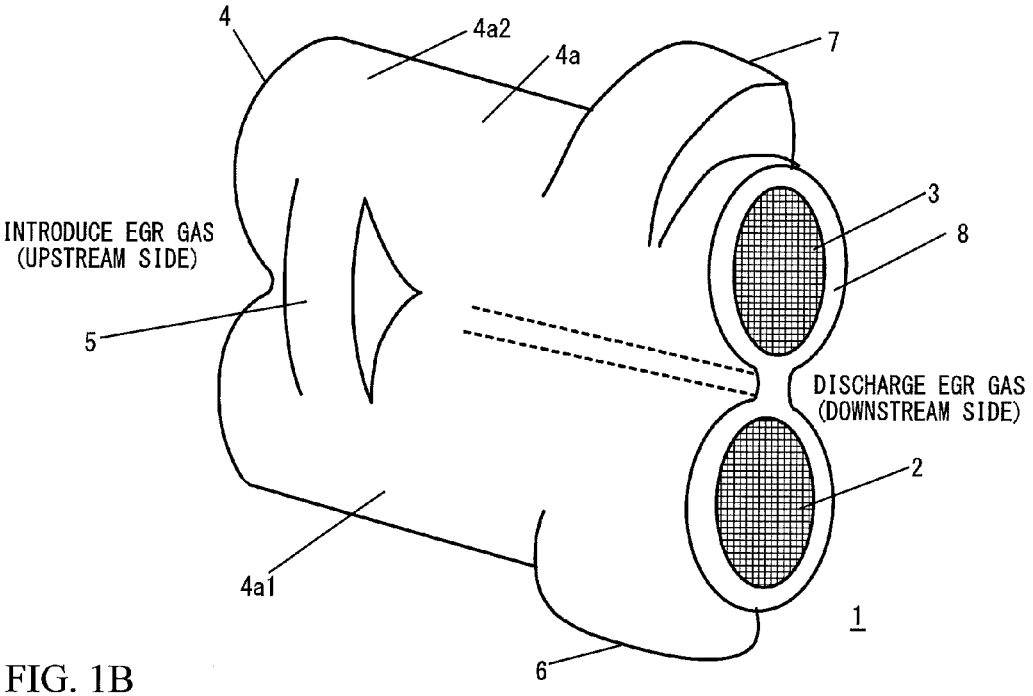
FIG. 1A is a perspective view of an EGR cooler of a first embodiment viewed from a rear side.

Hereinafter, a description will be given of embodiments of the present invention with reference to the attached drawings. In the drawings, the dimensions of each portion, the ratio, and the like may not completely correspond to the actual ones. Some drawings omit the illustration of details.

First Embodiment

A description will first be given of an EGR cooler 1 of a first embodiment with reference to FIG. 1A through FIG. 9. The EGR cooler 1 is an example of a heat exchanger, and the heat exchanger disclosed in the present description can cool a variety of fluids. The EGR cooler 1 of the first embodiment is installed in an exhaust gas recirculation device installed in an internal-combustion engine. Thus, a fluid to be cooled in the first embodiment is EGR (Exhaust Gas Recirculation) gas.

Figure 1B:
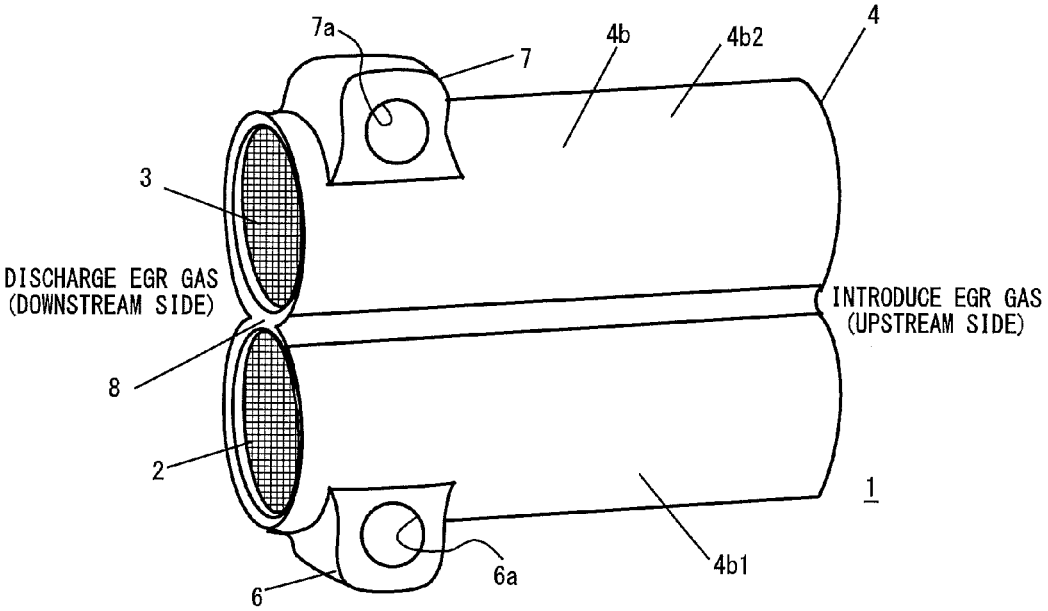
FIG. 1B is a perspective view of the EGR cooler of the first embodiment viewed from a front side.
Figure 2:
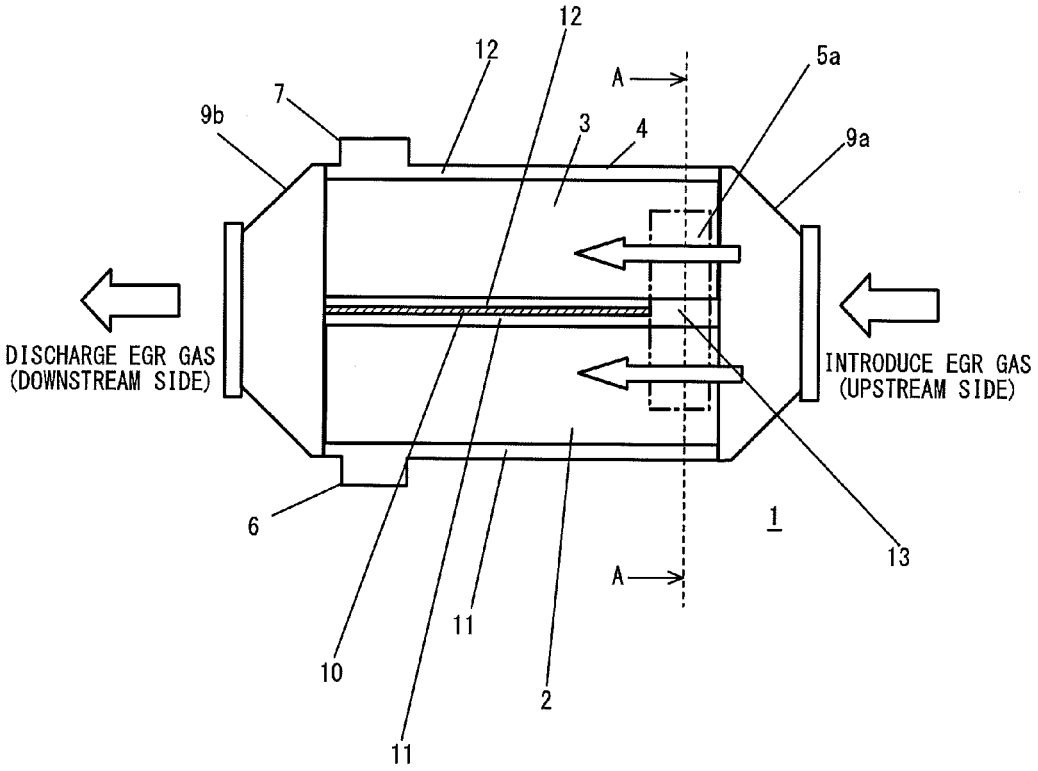
FIG. 2 is an explanatory diagram schematically illustrating the inside of the EGR cooler of the first embodiment.
Figure 3:
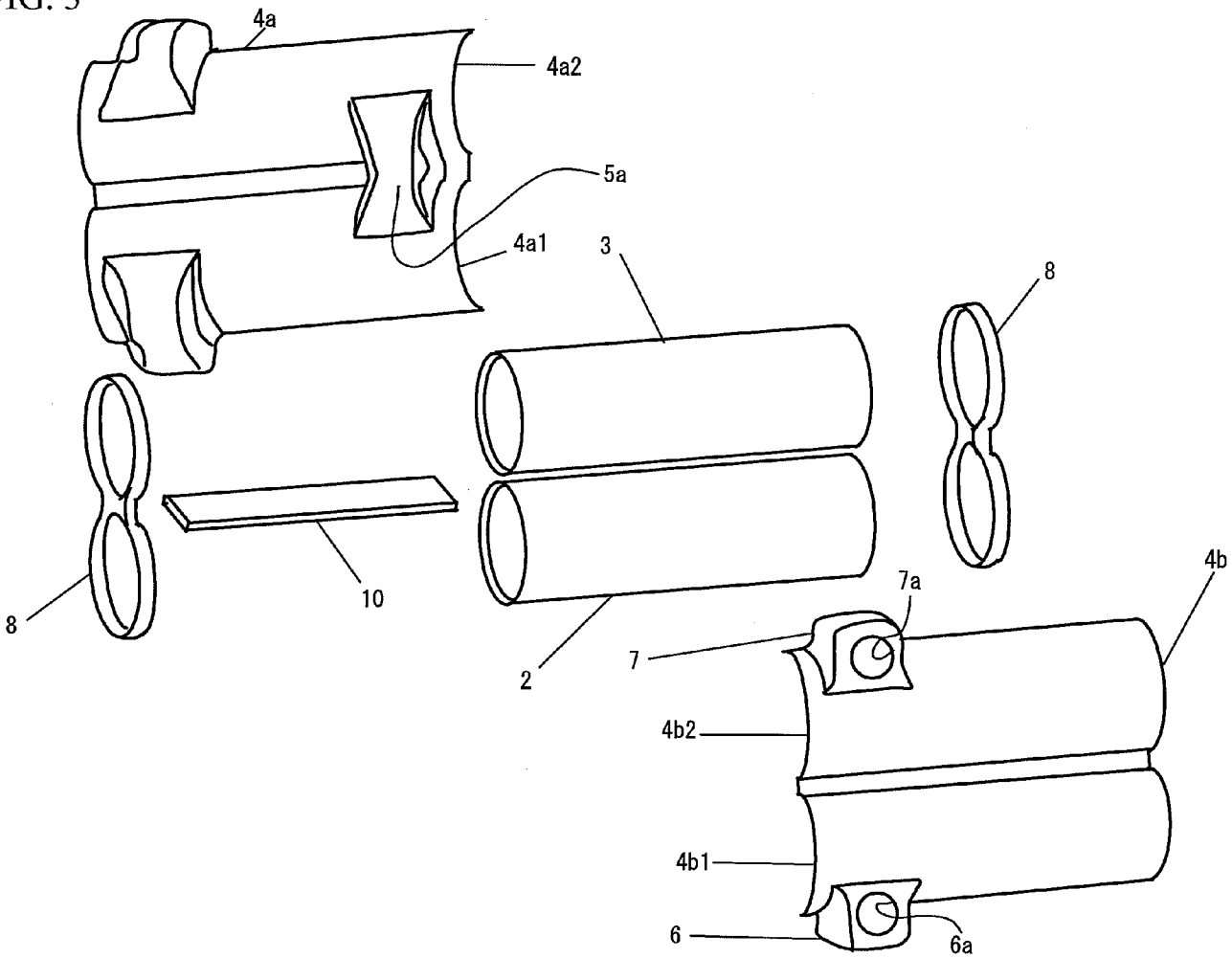
FIG. 3 is an explanatory diagram illustrating main portions of the disassembled EGR cooler of the first embodiment.
Figure 4:
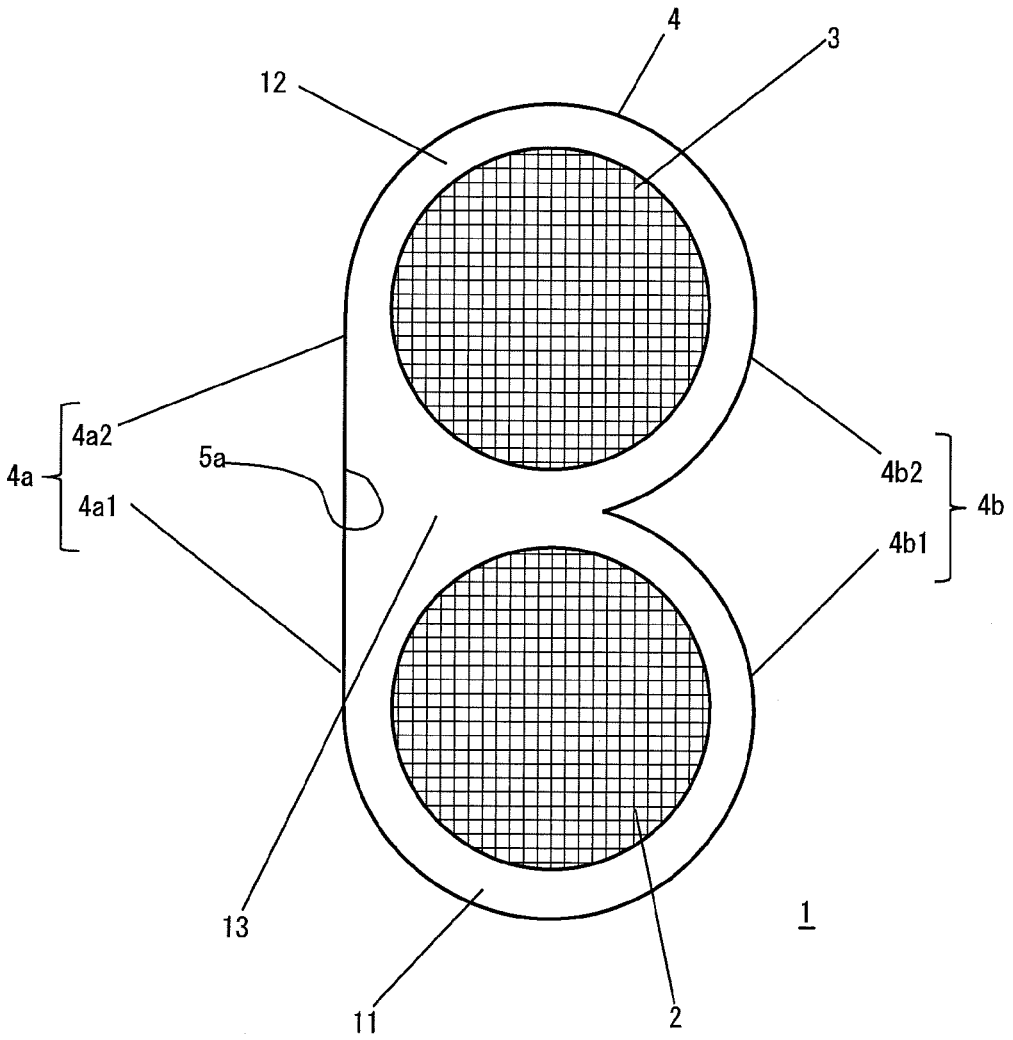
FIG. 4 is a cross-sectional view taken along line A-A in FIG. 2.
Figure 5A:
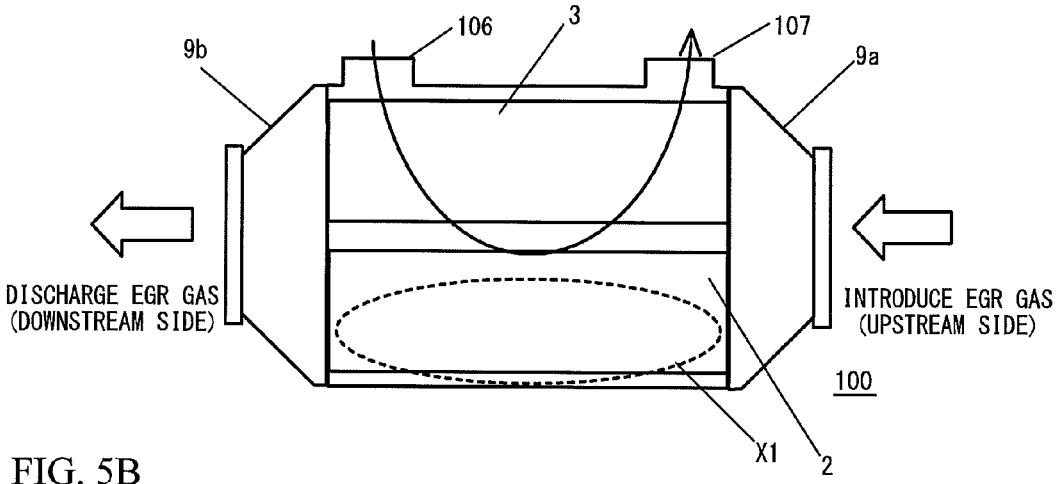
FIG. 5A through FIG. 5C are explanatory diagrams schematically illustrating flow states of cooling water in comparative examples.
Figure 5B:
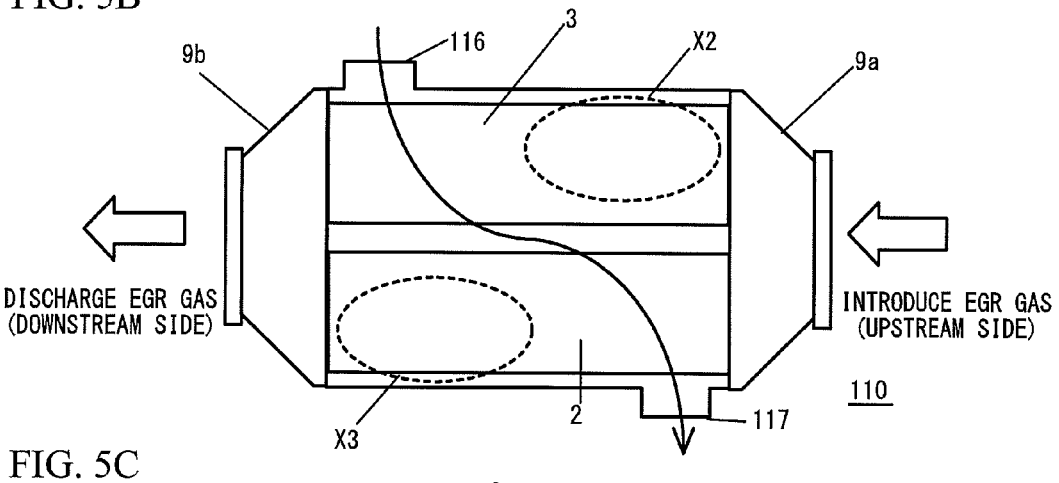
Figure 5C:
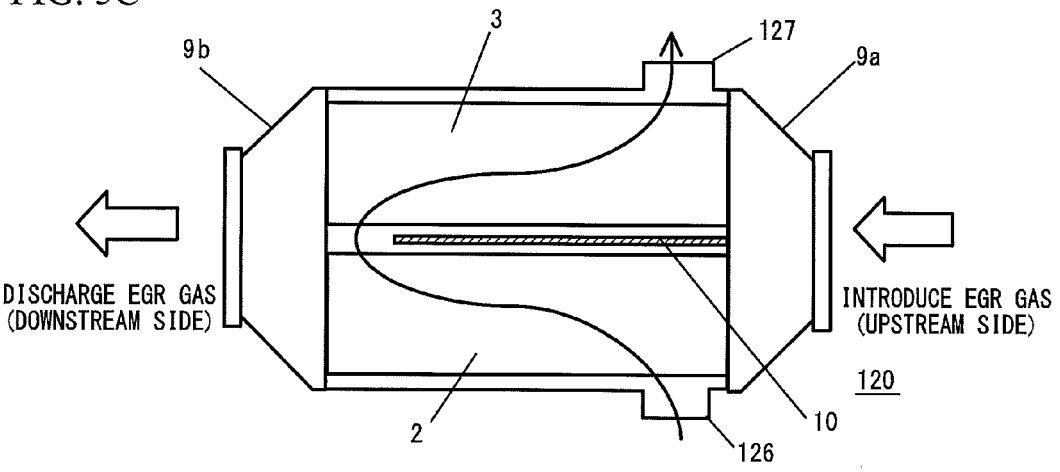

FIG. 1A is a perspective view of the EGR cooler 1 of the first embodiment viewed from a rear side, and FIG. 1B is a perspective view of the EGR cooler 1 of the first embodiment from a front side. FIG. 2 is an explanatory diagram schematically illustrating the inside of the EGR cooler 1 of the first embodiment. FIG. 3 is an explanatory diagram illustrating main portions of the disassembled EGR cooler 1 of the first embodiment. FIG. 4 is a cross-sectional view taken along line A-A in FIG. 2. FIG. 5A through FIG. 5C are explanatory diagrams schematically illustrating flow states of cooling water in comparative examples.

As illustrated in FIG. 1A through FIG. 2, the EGR cooler 1 includes two heat exchanger bodies arranged in parallel to each other: a first heat exchanger body 2 and a second heat exchanger body 3. A fluid to be cooled, which is EGR gas in the present embodiment, flows through each of the first heat exchanger body 2 and the second heat exchanger body 3. The EGR gas flows in one direction. The first heat exchanger body 2 and the second heat exchanger body 3 are made of silicon carbide (SiC) ceramic. Ceramic materials have high-efficiency thermal conduction and high corrosion resistance. Thus, ceramic materials having a high thermal conductivity are suitable for the heat exchanger body. The first heat exchanger body 2 and the second heat exchanger body 3 have the same structure. Each of them is cylindrically formed, and has a path formed therein to allow EGR gas to pass therethrough. The first heat exchanger body 2 and the second heat exchanger body 3 heat-exchange with cooling water flowing through a first refrigerant passage 11 and a second refrigerant passage 12 described in details later, thus cooling the EGR gas. The number of heat exchanger bodies is not limited to two, and more than two heat exchanger bodies may be installed. Additionally, the shape of the heat exchanger body is not limited to a cylindrical shape, and may be other shapes.

The EGR cooler 1 includes a housing 4 that forms a coolant passage allowing a coolant to flow therethrough around each of the heat exchanger bodies. More specifically, the housing 4 forms the first coolant passage 11 around the first heat exchanger body 2, and the second coolant passage 12 around the second heat exchanger body 3. The housing 4 is made of stainless steel (SUS). As illustrated in FIG. 3, the combination of a first halved member 4*a* and a second halved member 4*b* almost forms the exterior shape of the housing 4. The first halved member 4*a* includes a first curved portion 4*a*1 to be located around the first heat exchanger body 2 and a second curved portion 4*a*2 to be located around the second heat exchanger body 3. In the same manner, the second halved member 4*b* includes a first curved portion 4*b*1 to be located around the first heat exchanger body 2 and a second curved portion 4*b*2 to be located around the second heat exchanger body 3. The first curved portion 4*b*1 of the second halved member 4*b* has a coolant inlet portion 6 described in details later. The second curved portion 4*b*2 of the second halved member 4*b* has a coolant outlet portion 7. A coolant inlet port 6*a* is formed in the coolant inlet portion 6. A coolant outlet port 7*a* is formed in the coolant outlet portion 7. Although any type of coolant may be used, the present embodiment uses cooling water.

The first halved member 4*a* and the second halved member 4*b* are assembled to face each other so that two cylindrical portions are formed, forming the housing 4. In the housing 4, enclosed are the first heat exchanger body 2 and the second heat exchanger body 3. Ring members 8, each having a shape in which two ring-shaped parts are connected, are mounted to both ends of the housing 4. This allows the first heat exchanger body 2 and the second heat exchanger body 3 to be supported by the housing 4, and prevents the leakage of cooling water.

The first heat exchanger body 2 and the second heat exchanger body 3 are enclosed in the housing 4 and supported by the ring members 8, forming the first coolant passage 11 and the second coolant passage 12. In this structure, the first coolant passage 11 and the second coolant passage 12 are communicated with each other across almost the entire area in a longitudinal direction of the first heat exchanger body 2 and the second heat exchanger body 3. The EGR cooler 1 of the present embodiment includes a plate-like separator 10 that forms a separating portion that separates the first coolant passage 11 and the second coolant passage 12. To form the separating portion, the shapes of the first halved member 4*a* and the second halved member 4*b* may be changed. For example, the separating portion may be formed when the first halved member 4*a* and the second halved member 4*b* are assembled.

As illustrated in FIG. 2, the separator 10 is fixed at a side at which the EGR gas is discharged. That is to say, the separator 10 is located between the first heat exchanger body 2 and the second heat exchanger body 3 so that a communicating portion 13 that allows the first coolant passage 11 to communicate with the second coolant passage 12 at the upstream side of the flow direction of the EGR gas is formed. As described above, the separator 10 separates the first coolant passage 11 and the second coolant passage 12, but is fixed in the housing 4 so that the communicating portion 13 is left.

The EGR cooler 1 includes the coolant inlet portion 6 and the coolant outlet portion 7 in the housing 4 as described above. The coolant inlet portion 6 and the coolant outlet portion 7 are located in a position corresponding to a first end in the flow direction of the EGR gas. That is to say, the coolant inlet portion 6 and the coolant outlet portion 7 are located at the same end in the flow direction of the EGR gas. The present embodiment provides the coolant inlet portion 6 and the coolant outlet portion 7 at the downstream side of the flow direction of the EGR gas. The present embodiment provides the communicating portion 13 at the upstream side of the flow direction of the EGR gas. Therefore, cooling water, which is a coolant in the present embodiment, is introduced from the downstream side of the flow direction of the EGR gas, and flows toward the upstream side of the flow direction of the EGR gas. The cooling water then turns back its flow direction at the upstream side of the flow direction of the EGR gas, and is discharged at the downstream side of the flow direction of the EGR gas. The coolant inlet portion 6 is located at the lower side, and the coolant outlet portion 7 is located at the upper side. Both the coolant inlet portion 6 and the coolant outlet portion 7 may be located at the upstream side of the flow direction of the EGR gas.

Here, a description will be given of a positional relation between the communicating portion 13 and the coolant inlet portion 6 and the coolant outlet portion 7. As described above, the coolant inlet portion 6 and the coolant outlet portion 7 are located in a position corresponding to a first end in the flow direction of the EGR gas. On the other hand, the communicating portion 13 is located in a position corresponding to a second end in the flow direction of the EGR gas. This structure allows cooling water to flow along the first heat exchanger body 2 and the second heat exchanger body 3 located in parallel.

As illustrated in FIG. 4, the EGR cooler 1 includes a flow passage area increasing portion 5*a* that increases the flow passage area of the communicating portion 13. The flow passage area increasing portion 5*a* is formed by a protruding portion 5 located on the rear side of the housing 4 as clearly illustrated in FIG. 1A and FIG. 1B. As clearly illustrated in FIG. 3 and FIG. 4, when the protruding portion 5 is viewed from the inside of the housing 4, a recessed flow passage area increasing portion 5*a* is formed. The flow passage area increasing portion 5*a* is provided in a location corresponding to the location of the communicating portion 13. This structure reduces stagnation of cooling water, and allows cooling water to smoothly flow from the first refrigerant passage 11 to the second refrigerant passage 12.

Although the illustration is omitted in FIG. 1A, FIG. 1B and FIG. 3, the EGR cooler 1 includes cone-shaped members at its upstream end and downstream end. More specifically, an upstream cone member 9*a* is located at the upstream side of the flow direction of the EGR gas. A downstream cone member 9*b* is located at the downstream side of the flow direction of the EGR gas. The upstream cone member 9*a* is a member functioning as an introducing portion that introduces the EGR gas to the first heat exchanger body 2 and the second heat exchanger body 3 in the housing 4. The downstream cone member 9*b* is a member functioning as a discharging portion that discharges the EGR gas from the first heat exchanger body 2 and the second heat exchanger body 3 in the housing 4. The upstream cone member 9*a* and the downstream cone member 9*b* are bonded to the housing 4 by brazing so that the end having a larger diameter covers the end of the housing 4.

The EGR cooler 1 of the present embodiment has the above described outline structure. The EGR cooler 1 introduces cooling water from the downstream side of the flow direction of the EGR gas to the upstream side. The cooling water turns back its flow direction at the upstream side, flows toward the downstream side, and is discharged at the downstream side. The above described path of the cooling water allows the flow of the cooling water introduced from the coolant inlet portion 6 and having a lower temperature to be countercurrent to the flow of the EGR gas. Accordingly, the cooling efficiency of the EGR cooler is improved. The increase in the cooling efficiency makes cooling water easily boiled, but the EGR gas temperature near the coolant outlet portion 7 at which the temperature of the cooling water is high is decreased, and thus a boil of the cooling water can be prevented. The characteristics of the above described EGR cooler 1 will be described by presenting comparative examples with reference to FIG. 5A through FIG. 5C.

With reference to FIG. 5A, an EGR cooler 100 includes a coolant inlet portion 106 at the downstream side of the flow direction of the EGR gas and a coolant outlet portion 107 at the upstream side of the flow direction of the EGR gas. The coolant inlet portion 106 and the coolant outlet portion 107 are located at the upper side in the figure. Unlike the EGR cooler 1 of the first embodiment, the separator 10 is not provided. Cooling water in the EGR cooler 100 hardly reaches the periphery of the first heat exchanger body 2 located at the lower side. That is to say, the flow toward the coolant outlet portion 107 is strong in the flow of the cooling water introduced from the coolant inlet portion 106, and the cooling water hardly reaches the periphery of the first heat exchanger body 2. As a result, stagnation of the flow of the cooling water easily occurs in the region indicated by X1 in FIG. 5A, and sufficient cooling efficiency is hardly achieved.

With reference to FIG. 5B, an EGR cooler 110 includes a coolant inlet portion 116 at the downstream side of the flow direction of the EGR gas and a coolant outlet portion 117 at the upstream side of the flow direction of the EGR gas. The separator 10 is not provided. The coolant inlet portion 116 is located at the upper side in FIG. 5B, while the coolant outlet portion 117 is located at the lower side in FIG. 5B. Thus, the coolant inlet portion 116 is located diagonally to the coolant outlet portion 117 in the EGR cooler 110. Cooling water in the EGR cooler 110 hardly reaches the periphery of the first heat exchanger body 2 at the downstream side and the periphery of the second heat exchanger body 3 at the upper side. That is to say, the flow toward the coolant outlet portion 117 is strong in the flow of the cooling water introduced from the coolant inlet portion 116, and the cooling water hardly reaches the periphery of the first heat exchanger body 2 at the downstream side and the periphery of the second heat exchanger body 3 at the upstream side. As a result, stagnation of the cooling water easily occurs in the regions indicated by X2 and X3 in FIG. 5B, and thus sufficient cooling efficiency is hardly achieved.

With reference to FIG. 5C, an EGR cooler 120 includes a coolant inlet portion 126 and a coolant outlet portion 127 at the upstream side of the flow direction of the EGR gas. The separator 10 is provided. However, the separator 10 is fixed at the upstream side of the flow direction of the EGR gas, and a communicating portion is formed at the downstream side. That is to say, the EGR cooler 120 has the structure in which the positions of the coolant inlet portion, the coolant outlet portion, and the communicating portion are switched around those of the EGR cooler 1 of the first embodiment. The cooling water discharged from the coolant outlet portion 127 is already circulated in the EGR cooler 120, and is in a state where heat exchange is already performed, thus having a high temperature. The high-temperature cooling water heat-exchanges with high-temperature EGR gas introduced through the upstream cone member 9*a*, and thus a boil of the cooling water easily occurs. Therefore, the EGR cooler 120 can be improved in terms of effective cooling.

As described above, the comparative examples can be improved in terms of the occurrence of stagnation or the like, and reveal that the cooling by the EGR cooler 1 of the first embodiment is effective.

Hereinafter, a description will be given of the flow state of the cooling water in each portion of the EGR cooler 1 with use of comparative examples.

Figure 6:
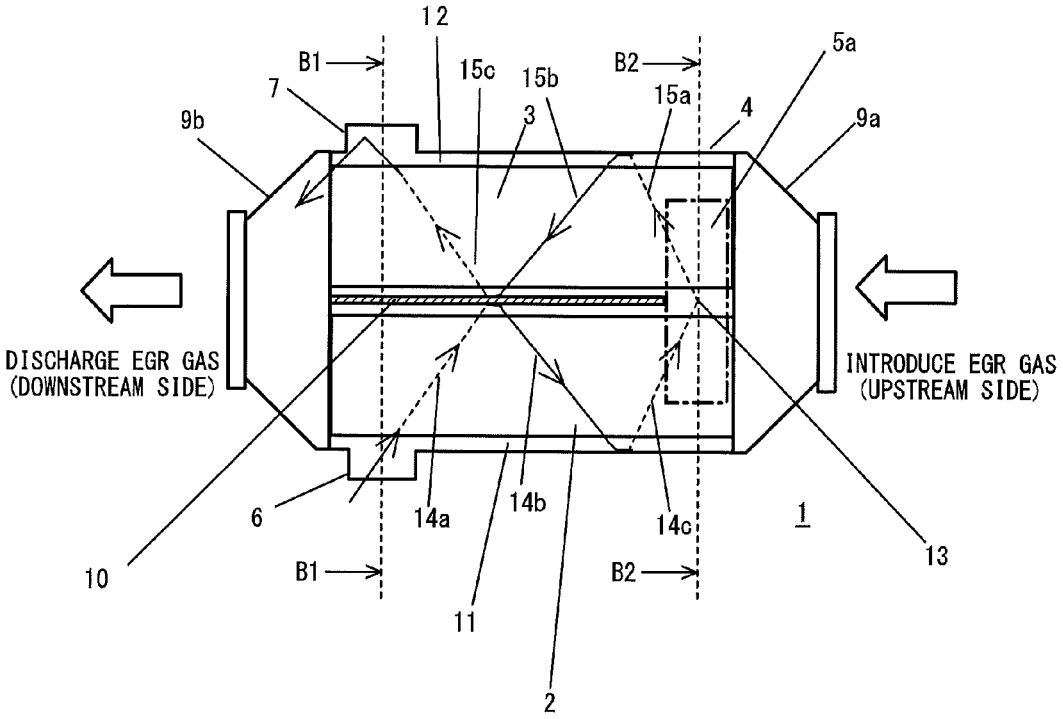
FIG. 6 is an explanatory diagram schematically illustrating cooling water helically flowing through the EGR cooler of the first embodiment.

As illustrated in FIG. 6, the coolant helically flows. That is to say, the cooling water introduced into the housing 4 from the coolant inlet portion 6 helically flows through the first coolant passage 11 as indicated by arrows 14*a*, 14*b* and 14*c* in FIG. 6. The cooling water flows into the second coolant passage 12 through the communicating portion 13, and also helically flows through the second coolant passage 12 as indicated by arrows 15*a*, 15*b* and 15*c* in FIG. 6. The first coolant passage 11 and the second coolant passage 12 are separated by the separator 10, thus enabling to generate a helical flow in each passage. The helical flow of the cooling water allows the cooling water to flow along the external walls of the first heat exchanger body 2 and the second heat exchanger body 3, thus reducing stagnation as much as possible. This improves cooling performance.

Figure 7A:
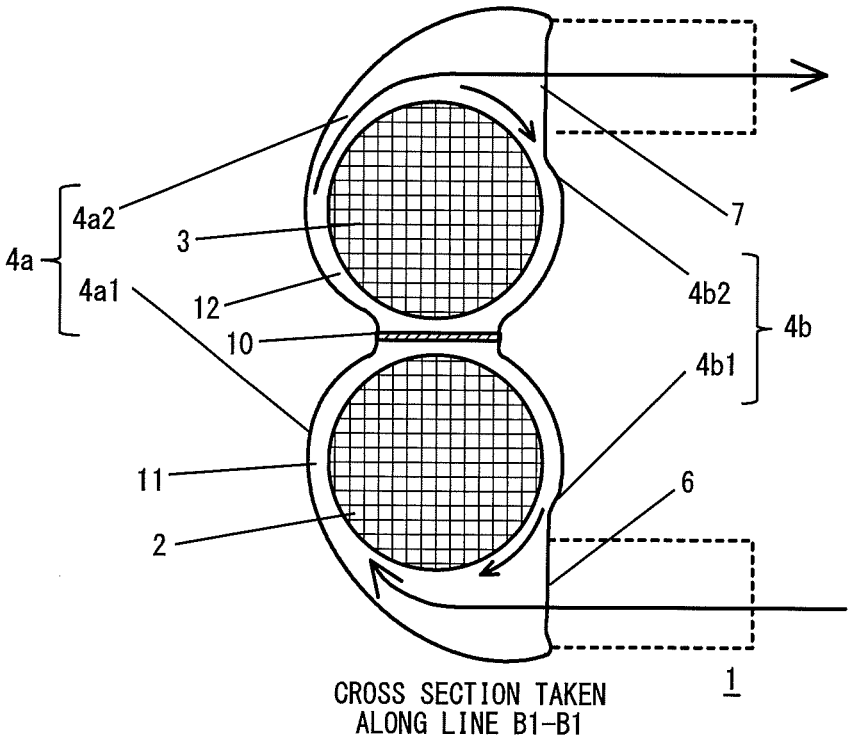
FIG. 7A is a cross-sectional view taken along line B1-B1 in FIG. 6.
Figure 7B:
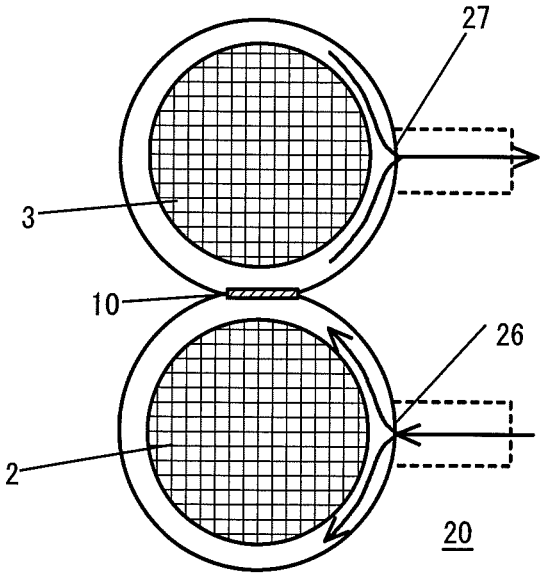
FIG. 7B is a cross-sectional view of a comparative example corresponding to FIG. 7A.

With reference to FIG. 7A, the coolant inlet portion 6 is offset from the first heat exchanger body 2. More specifically, the coolant inlet portion 6 is located on the lateral side of the first heat exchanger body 2, and is located in the position offset from the center axis of the first heat exchanger body 2. Thus, the introduced cooling water can form a swirl flow at the time of being introduced. Once the swirl flow is generated, it can helically flow through the first coolant passage 11 and the second coolant passage 12. Additionally, the coolant outlet portion 7 is also offset from the second heat exchanger body 3. More specifically, the coolant outlet portion 7 is located on the lateral side of the second heat exchanger body 3, and is located in the position offset from the center axis of the second heat exchanger body 3. This allows the cooling water helically flowing to be smoothly discharged to the outside of the housing 4. In contrast, an EGR cooler 20 of a comparative example illustrated in FIG. 7B provides a coolant inlet portion 26 so as to correspond to the center portion of the first heat exchanger body 2. A coolant outlet portion 17 is also provided so as to correspond to the center portion of the second heat exchanger body 3. Thus, the cooling water introduced from the coolant inlet portion 26 easily collides with the first heat exchanger body 2, and pressure loss easily occurs. In a coolant outlet portion 27, the cooling water flowing around the second heat exchanger body 3 from one side easily collides with the cooling water flowing around the second heat exchanger body 3 from another side, and thus pressure loss also easily occurs. The EGR cooler 1 of the first embodiment can avoid the above described inexpedience.

Figure 8A:
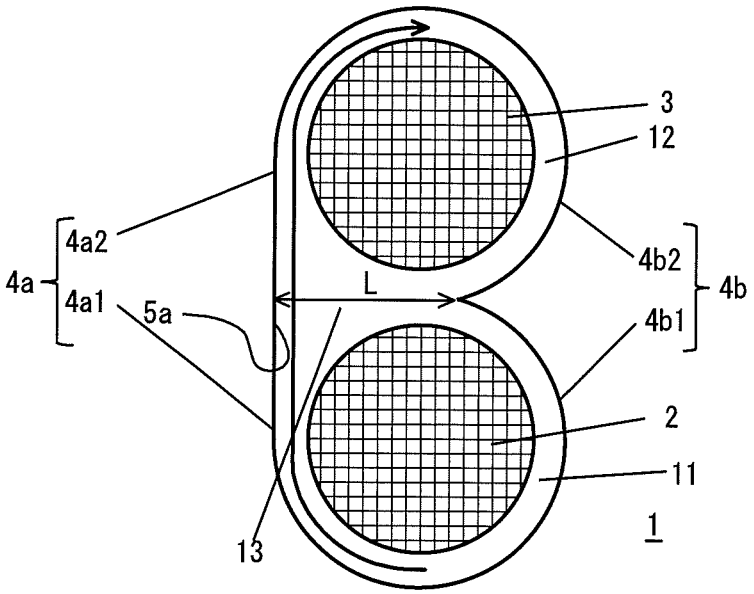
FIG. 8A is a cross-sectional view taken along line B2-B2 in FIG. 6.
Figure 8B:
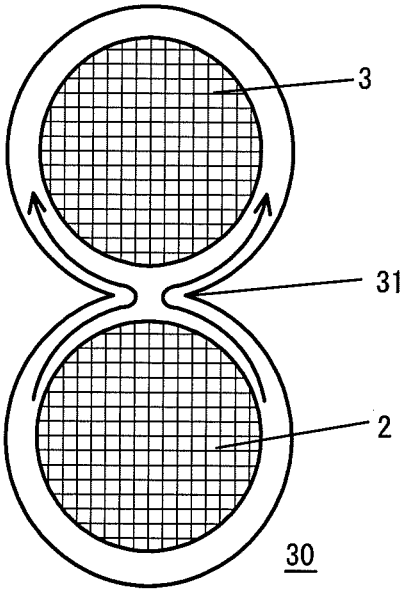
FIG. 8B is a cross-sectional view of a comparative example corresponding to FIG. 8A.
Figure 9:
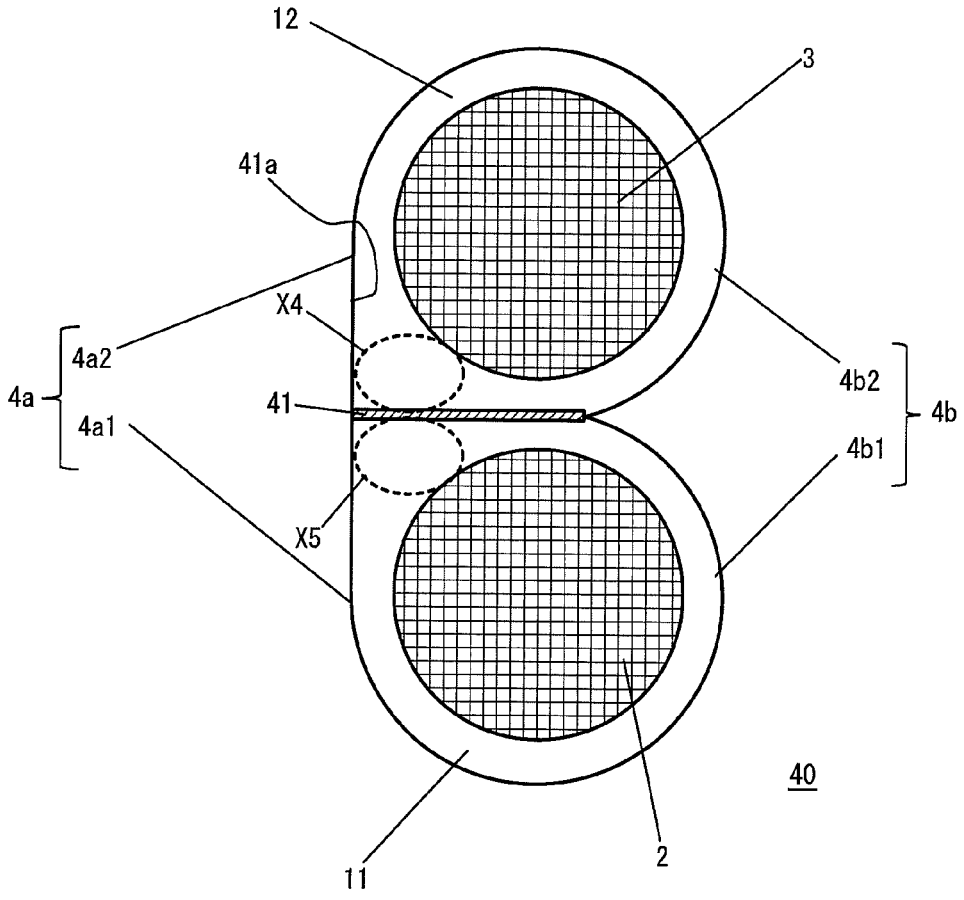
FIG. 9 is a cross-sectional view of a comparative example.

With reference to FIG. 8A, the EGR cooler 1 of the present embodiment leaves a distance L in the communicating portion 13 and forms the flow passage area increasing portion 5*a*, enabling to smoothly guide the helical swirl flow from the first coolant passage 11 to the second coolant passage 12. That is to say, the occurrence of pressure loss in the communicating portion 13 can be reduced. In contrast, an EGR cooler 30 of a comparative example illustrated in FIG. 8B, no countermeasure is taken in the communicating portion, and a narrow part 31 is formed. As a result, the smooth transfer of the cooling water is prevented, and pressure loss occurs. The EGR cooler 1 of the first embodiment can avoid the above described inexpedience. As illustrated in FIG. 9, when a flow passage area increasing portion 41*a* is formed in other than the communicating portion, i.e., in a position where a separator 41 is provided, it is difficult to form a swirl flow in the regions indicated by X4 and X5 in FIG. 9, and the cooling water easily flows in the axial direction. The presence of such a part stops the helical flow. As a result, the smooth flow of the cooling water is prevented.

Second Embodiment

Figure 10:
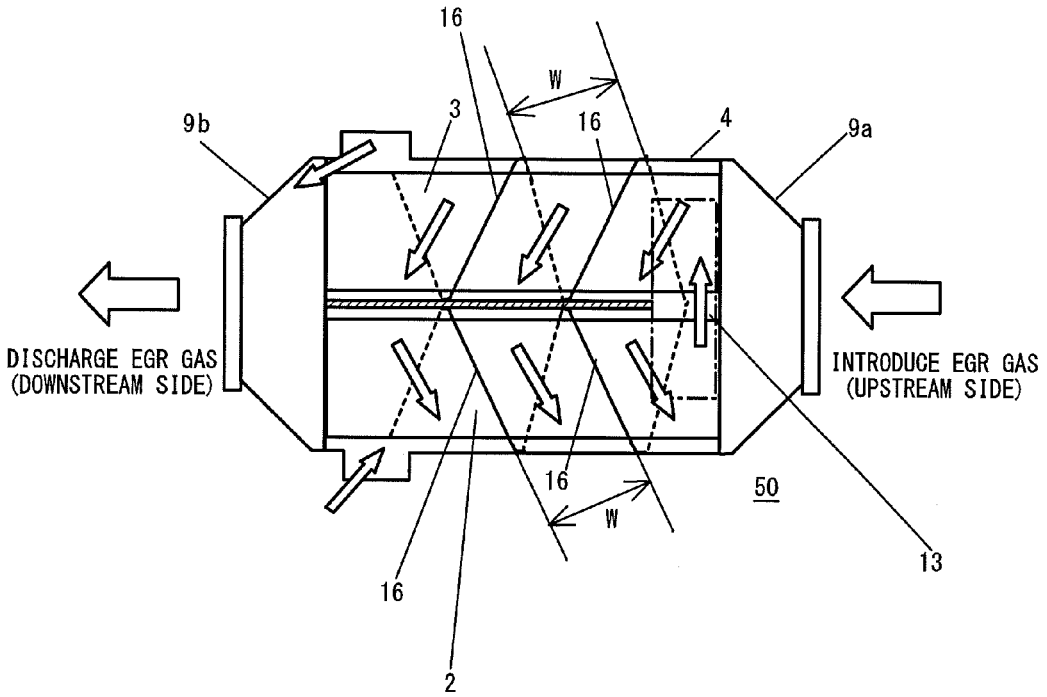
FIG. 10 is an explanatory diagram schematically illustrating the inside of an EGR cooler of a second embodiment.
Figure 11A:
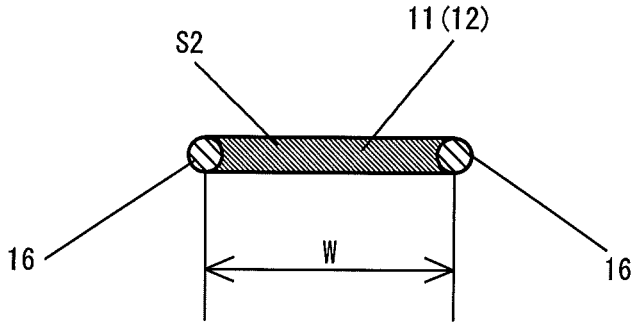
FIG. 11A illustrates a flow passage area in the EGR cooler of the second embodiment.
Figure 11B:
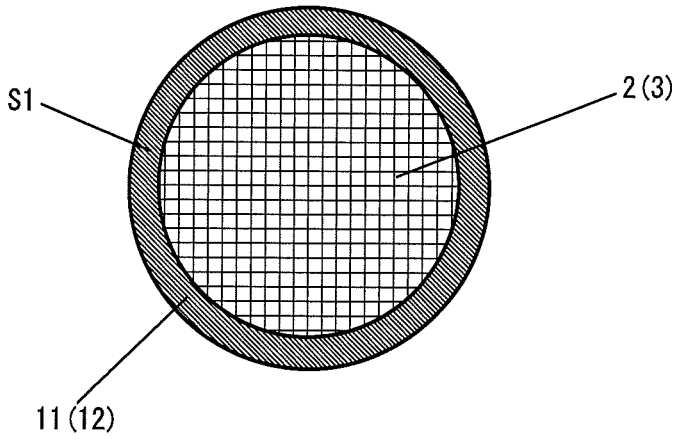
FIG. 11B is an explanatory diagram illustrating a flow passage area in a second comparative example.
Figure 12:
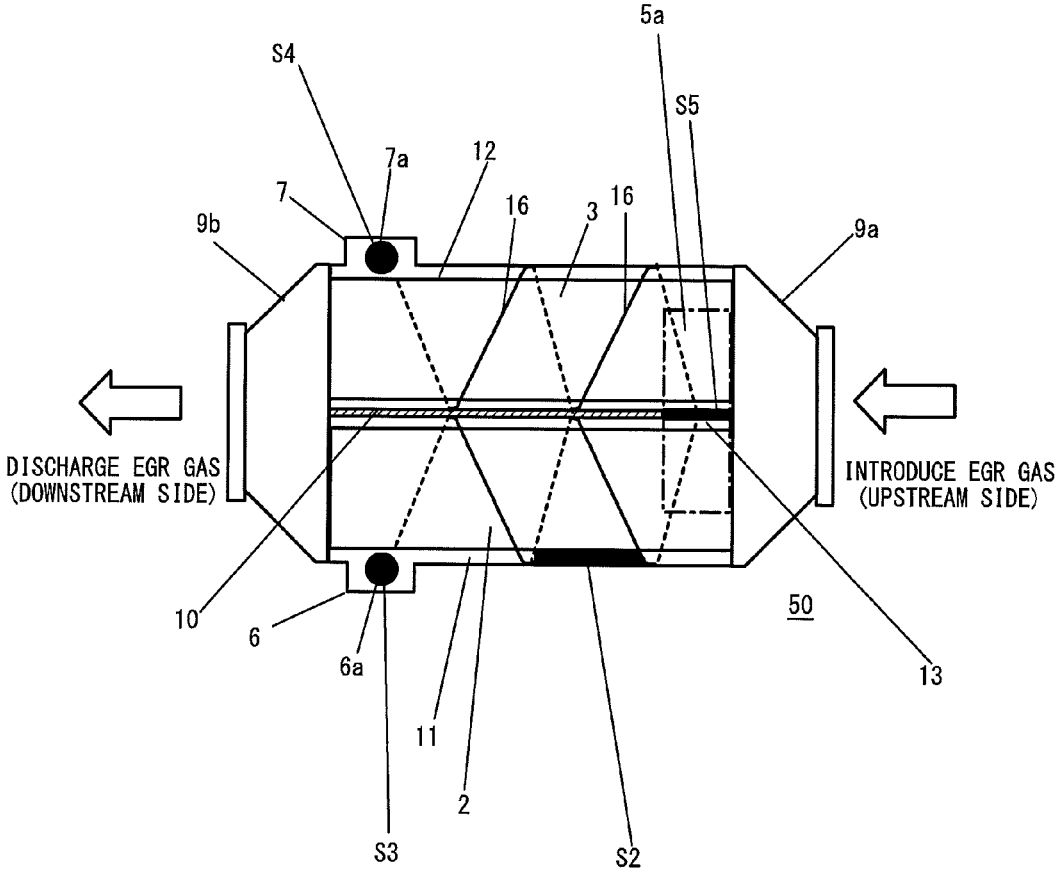
FIG. 12 is an explanatory diagram illustrating a flow passage area of each portion of the EGR cooler of the second embodiment.

A description will next be given of a second embodiment with reference to FIG. 10 through FIG. 12. An EGR cooler 50 of the second embodiment differs from the EGR cooler 1 of the first embodiment in the following point. That is to say, the EGR cooler 50 of the second embodiment differs from the first embodiment in that it includes coolant guide portions 16 that rectify the cooling water in the first coolant passage 11 and the second coolant passage 12. More specifically, the coolant guide portion 16 is formed of wire members helically located around the first heat exchanger body 2 and the second heat exchanger body 3. The provision of the helically located coolant guide portions 16 enables to form the swirl flow even when the flow rate of the cooling water introduced in the housing 4 is slow and the inertia force is weak. This reduces the occurrence of stagnation. Additionally, the coolant guide portions 16 located at intervals of an arrangement width (pitch) W reduce the flow passage cross-sectional area as illustrated in FIG. 11A, and thus increase the flow rate of the cooling water of the same quantity. As a result, heat-transfer efficiency increases, and temperature efficiency increases. FIG. 11B illustrates a flow passage area S1 without the coolant guide portion 16. When the coolant guide portion 16 is not provided, the ring shape of the first coolant passage 11 or the second coolant passage 12 defines the flow passage area, and thus the flow passage area is greater than the flow passage area S2 with the coolant guide portion 16 illustrated in FIG. 11A. In other words, the provision of the coolant guide portions 16 allows the flow passage area to be defined by the arrangement width of the coolant guide portions 16, i.e., the pitch W and the gap between the heat exchanger body and the housing 4, thus enabling to make the flow passage area S2 less than the flow passage area S1.

Here, a description will be given of the flow passage area of each portion of the EGR cooler 50 of the second embodiment with reference to FIG. 12. In FIG. 12, the flow passage areas of the first coolant passage 11 and the second coolant passage 12 are represented by S2. The flow passage area of the coolant inlet portion 6, more specifically, the area of the coolant inlet port 6*a* is represented by S3. The flow passage area of the coolant outlet portion 7, more specifically, the area of the coolant outlet port 7*a* is represented by S4. The flow passage area of the communicating portion 13, more specifically, the flow passage area of the flow passage area increasing portion 5*a* is represented by S5. These flow passage areas S2 through S5 are equal to each other. Making the flow passage areas of the portions equal to each other as described above prevents the occurrence of local pressure loss. As a result, the cooling water can smoothly flows through the entire path, and good cooling performance can be obtained.

Third Embodiment

Figure 13:
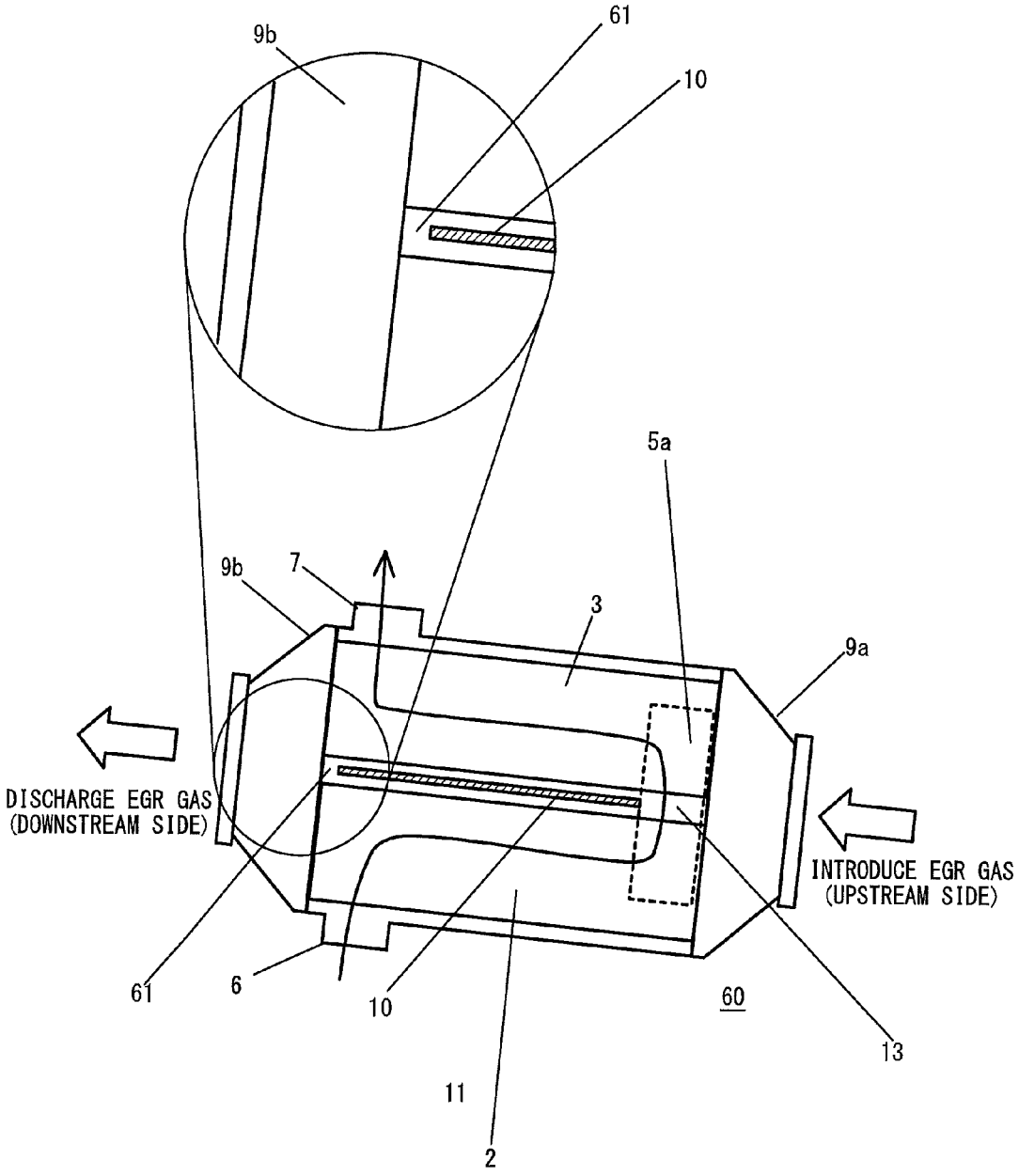
FIG. 13 is an explanatory diagram schematically illustrating an EGR cooler of a third embodiment.

A description will be given of a third embodiment with reference to FIG. 13. FIG. 13 is an explanatory diagram schematically illustrating an EGR cooler 60 of the third embodiment. The EGR cooler 60 of the third embodiment includes a deflation portion 61 in the separator 10 that forms a separating portion. When air is entrapped into a part of the coolant passage, the part in which air accumulates becomes exposed from the cooling water, and the exposed portion may become high in temperature. Especially, when the separator 10 is located as described in the present embodiment and the first coolant passage 11 and the second coolant passage 12 are separated, air may be accumulated in a part such as a corner of the flow passage. The part in which air accumulates becomes exposed from the cooling water. Thus, the deflation portion 61 is provided. The EGR cooler 60 is tilted and installed in a vehicle. More specifically, the EGR cooler 60 is tilted so that the deflation portion 61 is located further upper than the communicating portion 13 and installed in a vehicle. This allows the air to move directly to the coolant outlet portion 7 side, and to be discharged from the inside of the EGR cooler 60.

Fourth Embodiment

Figure 14:
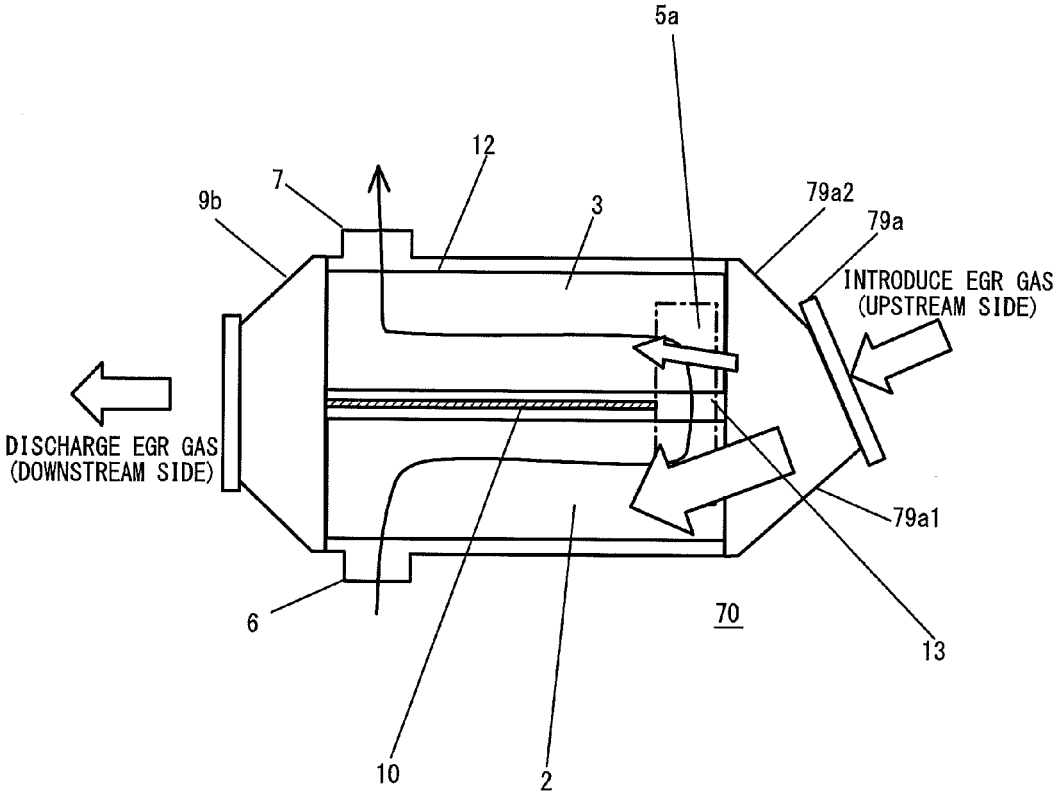
FIG. 14 is an explanatory diagram schematically illustrating an EGR cooler of a fourth embodiment.

A description will next be given of an EGR cooler 70 of a fourth embodiment with reference to FIG. 14. FIG. 14 is an explanatory diagram schematically illustrating the EGR cooler 70 of the fourth embodiment. The EGR cooler 70 of the fourth embodiment makes the inlet flow of the EGR gas to a heat exchanger body located closer to the coolant inlet portion 6, i.e., to the first heat exchanger body 2, greater than the inlet flow of the EGR gas to the second heat exchanger body 3. As a position becomes closer to the coolant inlet portion 6, the temperature of the coolant decreases, and the cooling performance increases. Thus, cooling efficiency as a heat exchanger is improved by allowing more fluid to be cooled to flow into the heat exchanger body having higher cooling performance. More specifically, the shape of an upstream cone member 79 is changed to increase the inlet flow of the EGR gas to the first heat exchanger body 2. The length of a lower edge 79*a*1 of the upstream cone member 79 is made to be greater than that of an upper edge 79*a*2 to change the volume allocation of the inside of an upstream cone member 79. That is to say, the volume at the first heat exchanger body 2 side is increased to achieve the state where the EGR gas more easily flows into the first heat exchanger body 2. This enables to cool the EGR gas more effectively.

Fifth Embodiment

Figure 15:
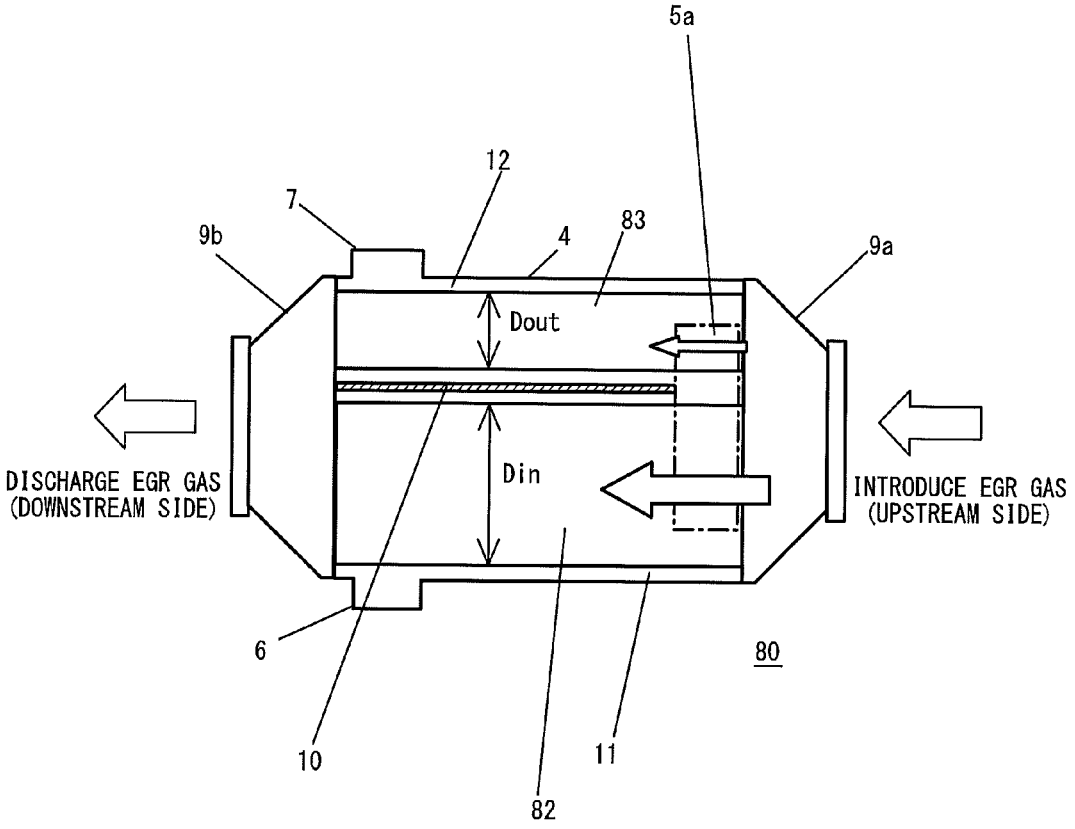
FIG. 15 is an explanatory diagram schematically illustrating an EGR cooler of a fifth embodiment.

A description will next be given of an EGR cooler 80 of a fifth embodiment with reference to FIG. 15. FIG. 15 is an explanatory diagram schematically illustrating the EGR cooler of the fifth embodiment. The EGR cooler 80 of the fifth embodiment makes the inlet flow of the EGR gas to the first heat exchanger body 2 greater than the inlet flow of the EGR gas to the second heat exchanger body 3 as with the EGR cooler 70 of the fourth embodiment. The fifth embodiment differs from the fourth embodiment in the means of changing the inlet flow of the EGR gas. In the EGR cooler 80 of the fifth embodiment, a first heat exchanger body 82 has a diameter Din greater than the diameter Dout of a second heat exchanger body 83. That is to say, the diameter of the first heat exchanger body 82, which is located closer to the coolant inlet portion 6, is made to be greater than the diameter of the second heat exchanger body 83 to increase the quantity of the EGR gas cooled in the first heat exchanger body 82. This enables to cool the EGR gas more effectively.

While the exemplary embodiments of the present invention have been illustrated in detail, the present invention is not limited to the above-mentioned embodiments, and other embodiments, variations and modifications may be made without departing from the scope of the present invention.

DESCRIPTION OF LETTERS OR NUMERALS

1, 50, 60, 70, 80 EGR cooler
2 first heat exchanger body
3 second heat exchanger body
4 housing
5 protruding portion
5*a* flow passage area increasing portion
6 coolant inlet portion
7 coolant outlet portion
8 ring member
9*a* upstream cone member
9*b* downstream cone member
10 separator
11 first coolant passage
12 second coolant passage
13 communicating portion

The invention claimed is:

1. A heat exchanger comprising:

heat exchanger bodies arranged in parallel, each allowing a fluid to be cooled to flow therethrough in one direction;

a housing that forms a coolant passage that allows a coolant to flow therethrough around each of the heat exchanger bodies;

a coolant inlet portion and a coolant outlet portion located in a position corresponding to first ends of the heat exchanger bodies in a flow direction of the fluid to be cooled, and introduces the coolant into the coolant passage in a direction intersecting with the parallel direction of the heat exchanger bodies, the flow direction of the fluid to be cooled coinciding with an extending direction of the heat exchanger bodies;

a coolant outlet portion that is located in the position corresponding to the first ends of the heat exchanger bodies in the flow direction of the fluid to be cooled, and discharges the coolant from the coolant passage in the direction intersecting with the parallel direction;

a separating portion that separates the coolant passages, each formed around the corresponding heat exchanger body, so that a communicating portion that allows the coolant passages to communicate with each other is left in a position corresponding to second ends of the heat exchanger bodies in the flow direction of the fluid to be cooled;

an upstream cone member that is located at a first end of the housing such that the fluid to be cooled is introduced to the heat exchanger bodies;

a downstream cone member that is located at a second end of the housing such that the fluid to be cooled is discharged from the heat exchanger bodies;

a flow passage area increasing portion that increases a flow passage area of the communicating portion, wherein the coolant inlet portion and the coolant outlet portion are spaced away from each other in the parallel direction, and are located outside of the heat exchange bodies; and wherein the flow passage area increasing portion is located at opposite to the coolant inlet portion and the coolant outlet portion of the housing.

2. The heat exchanger according to claim 1, wherein the coolant inlet portion and the coolant outlet portion are located at a downstream side of the flow direction of the fluid to be cooled in the housing.

3. The heat exchanger according to claim 1, wherein a coolant guide portion that rectifies the coolant is located in the coolant passage.

4. The heat exchanger according to claim 3, wherein the coolant guide portion is helically located around each of the heat exchanger bodies.

5. The heat exchanger according to claim 1, wherein a flow passage area of the coolant passage, a flow passage area of the communicating portion, a flow passage area of the coolant inlet portion, and a flow passage area of the coolant outlet portion are equal to each other.

6. The heat exchanger according to claim 1, wherein the separating portion includes a deflation portion.

7. The heat exchanger according to claim 1, wherein the coolant inlet portion is offset from central axis of the heat exchanger body.

8. The heat exchanger according to claim 1, wherein an inlet flow of the fluid to be cooled to a first heat exchanger body of the heat exchanger bodies is greater than an inlet flow of the fluid to be cooled to a second heat exchanger body of the heat exchanger bodies, the first heat exchanger body being located closer to the coolant inlet portion than the second heat exchanger body.

9. The heat exchanger according to claim 1, wherein the coolant outlet portion is offset from a central axis of the heat exchanger body.

* * * * *